US008606162B2

(12) United States Patent
Yoshikawa

(10) Patent No.: US 8,606,162 B2
(45) Date of Patent: Dec. 10, 2013

(54) FIXING DEVICE AND IMAGE FORMING APPARATUS IN WHICH A HEIGHT DIFFERENCE IS CIRCUMFERENTIALLY PROVIDED TO A PRESSING MEMBER

(75) Inventor: Takahiro Yoshikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 13/110,155

(22) Filed: May 18, 2011

(65) Prior Publication Data

US 2011/0293339 A1 Dec. 1, 2011

(30) Foreign Application Priority Data

May 28, 2010 (JP) ..... 2010-122241
Oct. 25, 2010 (JP) ..... 2010-238533

(51) Int. Cl.
*G03G 15/20* (2006.01)

(52) U.S. Cl.
USPC ..... 399/329; 399/333

(58) Field of Classification Search
USPC ..... 399/328, 329, 331, 333; 219/216
See application file for complete search history.

(56) References Cited

U.S. PATENT DOCUMENTS

| | | | | |
|---|---|---|---|---|
| 5,402,211 | A | 3/1995 | Yoshikawa | |
| 5,850,588 | A | 12/1998 | Yoshikawa | |
| 6,160,974 | A | 12/2000 | Yoshikawa et al. | |
| 6,501,914 | B2 | 12/2002 | Yoshikawa | |
| 6,757,502 | B2 | 6/2004 | Yoshikawa | |
| 6,775,509 | B2 * | 8/2004 | Shida et al. | 399/331 |
| 6,823,149 | B2 | 11/2004 | Yoshikawa et al. | |
| 7,043,185 | B2 | 5/2006 | Yoshikawa | |
| 7,127,204 | B2 | 10/2006 | Satoh et al. | |
| 7,174,124 | B2 | 2/2007 | Ishibashi et al. | |
| 7,292,801 | B2 | 11/2007 | Yoshikawa | |
| 7,313,353 | B2 | 12/2007 | Satoh et al. | |
| 7,366,456 | B2 | 4/2008 | Yoshikawa | |
| 7,460,797 | B2 | 12/2008 | Yoshikawa | |
| 7,653,321 | B2 | 1/2010 | Yoshikawa | |
| 7,672,607 | B2 | 3/2010 | Yoshikawa | |
| 8,045,906 | B2 * | 10/2011 | Funabiki | 399/333 |
| 8,204,421 | B2 * | 6/2012 | Hiraoka et al. | 399/329 |
| 2007/0059020 | A1 | 3/2007 | Yoshikawa | |
| 2007/0274748 | A1 | 11/2007 | Yoshikawa | |
| 2008/0101814 | A1 | 5/2008 | Yoshikawa | |
| 2009/0052927 | A1 | 2/2009 | Yoshikawa | |
| 2009/0148206 | A1 | 6/2009 | Yoshikawa | |
| 2010/0008683 | A1 | 1/2010 | Yoshikawa | |
| 2010/0226700 | A1 | 9/2010 | Yamada et al. | |
| 2010/0272458 | A1 | 10/2010 | Yoshikawa | |

FOREIGN PATENT DOCUMENTS

| | | |
|---|---|---|
| JP | 2003-21980 | 1/2003 |
| JP | 2005-208422 | 8/2005 |
| JP | 2007-3985 | 1/2007 |
| JP | 4632820 | 11/2010 |

* cited by examiner

*Primary Examiner* — William J Royer
(74) *Attorney, Agent, or Firm* — Oblon, Spivak, McClelland, Maier & Neustadt, L.L.P.

(57) ABSTRACT

A fixing device including a fixing member to fix a toner image on a sheet by application of heat and pressure and a pressing member to press the sheet against the fixing member. The pressing member is rotatable. A height difference is circumferentially provided to the pressing member, and is tapered from an end portion toward a portion contacting an edge of a small-size sheet. The pressing member has a greater hardness than the fixing member.

19 Claims, 10 Drawing Sheets

FIXING DEVICE AND IMAGE FORMING APPARATUS IN WHICH A HEIGHT DIFFERENCE IS CIRCUMFERENTIALLY PROVIDED TO A PRESSING MEMBER

CROSS-REFERENCE TO RELATED APPLICATIONS

The present patent application claims priority pursuant to 35 U.S.C. §119 from Japanese Patent Application Nos. 2010-122241 and 2010-238533, filed on May 28, 2010 and Oct. 25, 2010, respectively, each of which is hereby incorporated by reference herein in its entirety.

BACKGROUND

1. Field of the Invention

The present invention relates to a fixing device and an image forming apparatus.

2. Description of the Background

In a typical fixing device, a pressing roller is pressed against a fixing roller comprising a soft elastic body, whose surface is covered with a fluorine-containing resin. As a paper sheet passes through a pressing point between the pressing roller and the fixing roller, an edge of the sheet strongly scratches the fixing roller due to a linear velocity difference generated between a portion where the fixing roller contacts the edge of the sheet and a portion where the fixing roller contacts the pressing roller.

Thus, as small-size sheets (e.g., postcards) continuously pass the pressing point, both edges of the small-size sheets in width direction make scratches on the fixing roller. The scratches undesirably appear as low-gloss lines in a solid image formed on a large-size sheet (e.g., A4 sheet) thereafter.

In a market in which the maximum-size sheet in use is A4 or LT and small-size sheets are not frequently used, the above-described problem may not frequently occur. By contrast, in a market in which the maximum-size sheet in use is greater than A4 or LT and A4 or LT sheets are frequently used, the above-described problem frequently occurs.

In view of this situation, there has been a proposal to even out the scratches with a cleaning member or another proposal to remove paper powders that accelerate scratch making, in Japanese Patent Application Publication Nos. (hereinafter "JP-A") 2003-21980, 2007-3985, 2005-208422, and 2006-251165, for example.

However, the cleaning members disclosed in JP-2003-21980-A and JP-2007-3985-A have smooth surfaces that cannot effectively remove paper powder within a short time period. Even if the surface is rough, toner may be fixedly adhered to the cleaning member and adversely scratch the fixing roller. A technology disclosed in JP-2005-208422-A does detect scratch but does not prevent scratch. A technology disclosed in JP-2006-251165-A does not prevent scratch either.

SUMMARY

Exemplary aspects of the present invention are put forward in view of the above-described circumstances, and provide a novel fixing device and image forming apparatus that do not produce undesirable low-gloss lines in images formed on large-size sheets even after continuously producing images on small-size sheets.

In one exemplary embodiment, a novel fixing device includes a fixing member to fix a toner image on a sheet by application of heat and pressure and a pressing member to press the sheet against the fixing member. The pressing member is rotatable. A height difference is circumferentially provided to the pressing member, and is tapered from an end portion toward a portion contacting an edge of a small-size sheet. The pressing member has a greater hardness than the fixing member.

In another exemplary embodiment, a novel image forming apparatus includes the above-described fixing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
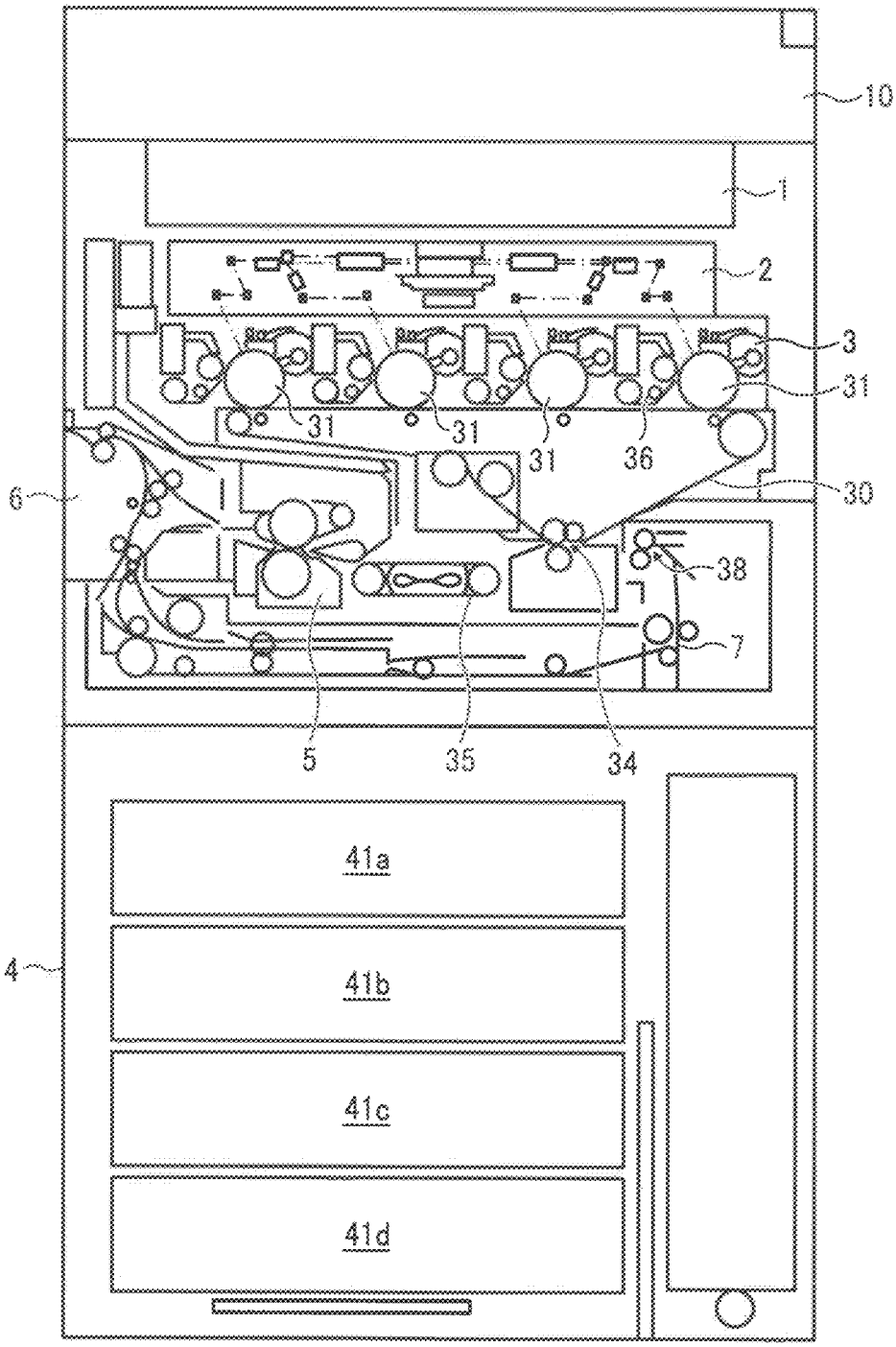
FIG. 1 schematically illustrates an image forming apparatus according to exemplary aspects of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result. For the sake of simplicity, the same reference number will be given to identical constituent elements such as parts and materials having the same functions and redundant descriptions thereof omitted unless otherwise stated.

FIG. 1 schematically illustrates an image forming apparatus according to exemplary aspects of the invention. This image forming apparatus is a digital color copier. A scanner 1 optically reads image information of a document. A writing device 2 forms electrostatic latent images on photoconductors 31 by emitting light beams thereto based on the image information read by the scanner 1 or external image information. The light beams corresponding to image information of black, magenta, yellow, and cyan are emitted to the respective photoconductors 31.

A developing device 3 supplies a toner to the irradiated portion on the photoconductor 31 to form a toner image. Each toner image is transferred onto an intermediate transfer member 30 from each photoconductor 31 to form a composite toner image. A cleaner 36 removes residual toner particles remaining on the photoconductor 31 after the toner image is transferred therefrom.

A paper feeder 4 feeds a sheet of paper from one of paper feed cassettes 41*a*, 41*b*, 41*c*, and 41*d* toward a registration part 38 via a paper feed path 7. The registration part 38 feeds the paper to a secondary transfer area 34 in synchronization with an entry of the composite toner image on the intermediate transfer member 30, so that the composite toner image is transferred from the intermediate transfer member 30 onto the paper. An automatic document feeder (ADF) 10 continuously feeds documents to the scanner 1. A fixing device 5 fixes a toner image on a paper.

The paper onto which the composite toner image is transferred in the secondary transfer area 34 is then fed to the fixing device 5 by a conveyance belt 35. The fixing device 5 fixes the composite toner image on the paper by applying heat and pressure. The paper having the fixed toner image thereon is discharged from the image forming apparatus by a discharger 6. Thus, a series of image forming processes is completed.

Embodiment 1

Figure 2:
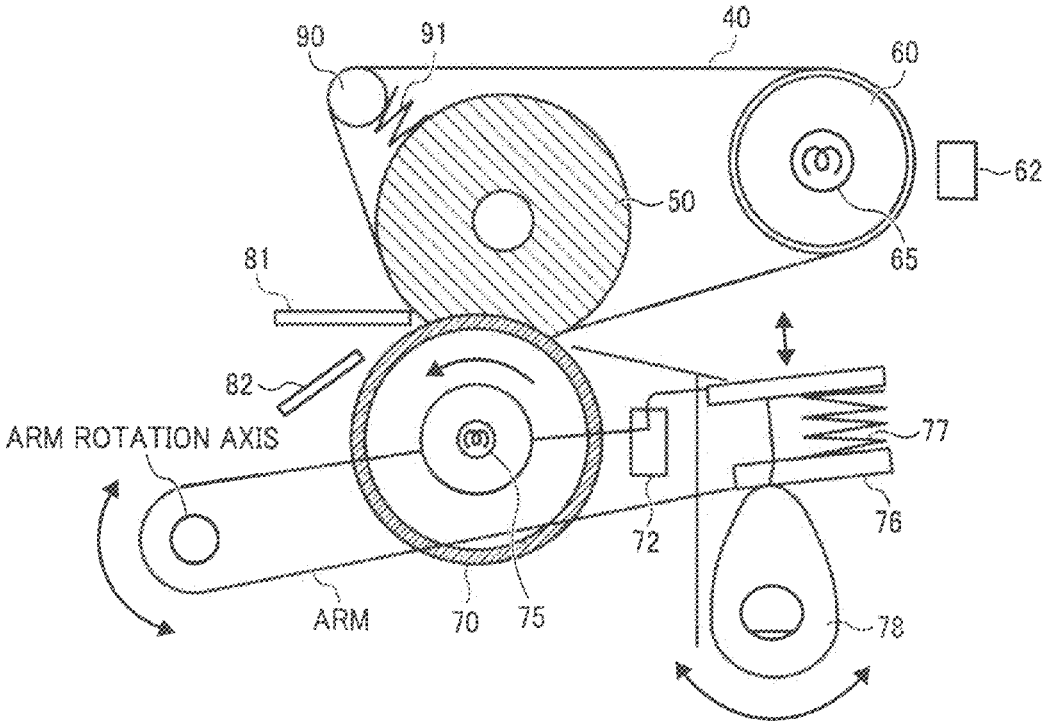
FIG. 2 schematically illustrates an embodiment of a fixing device employed in the image forming apparatus illustrated in FIG. 1.
Figure 3:
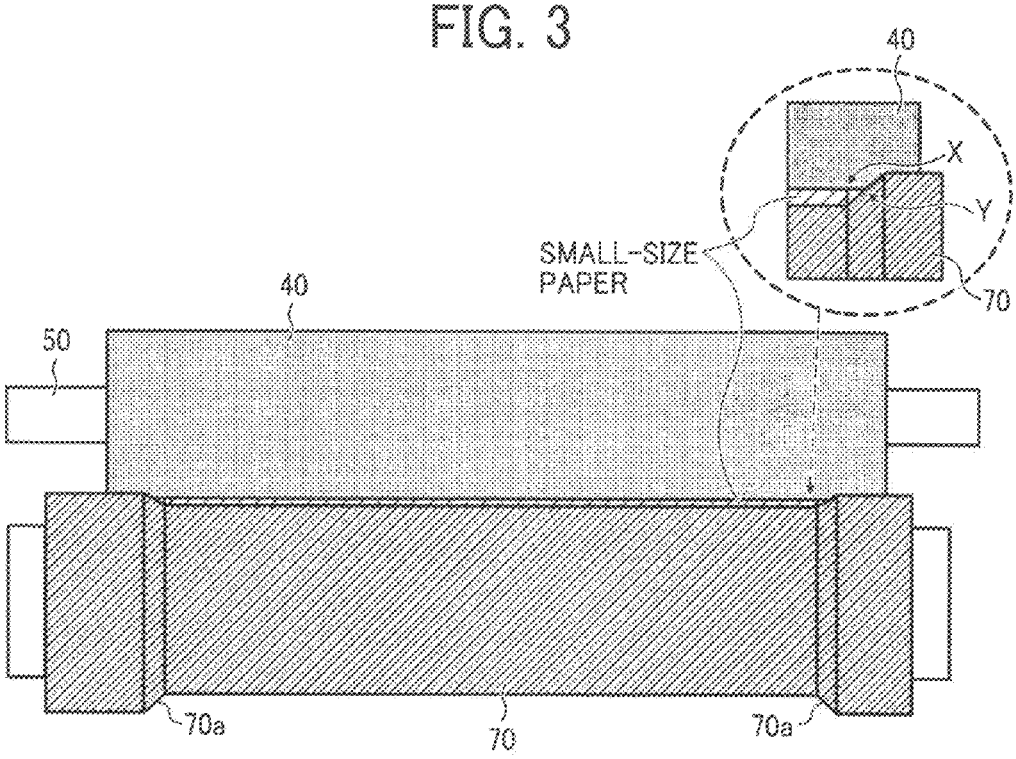
FIG. 3 schematically illustrates an embodiment of rollers employed in the fixing device illustrated in FIG. 2.

FIG. 2 schematically illustrates an embodiment of the fixing device employed in the image forming apparatus illustrated in FIG. 1. FIG. 3 schematically illustrates an embodiment of rollers employed in the fixing device illustrated in FIG. 2. Referring to FIG. 2, a fixing roller 50 is comprised of a rubber or foamed silicone rubber, whose surface is covered with a layer comprising a fluorine-containing resin and/or a fluorine-containing rubber. A heating roller 60 is a metallic pipe internally containing a heater 65. A fixing belt 40 is stretched across the fixing roller 50 and the heating roller 60. The fixing belt 40 is comprised of a film substrate of a metal (e.g., nickel, SUS) or a resin (e.g., polyimide, polyamide-imide), a silicone rubber, and a surface layer comprising a fluorine-containing resin.

The fixing belt 40 is driven to rotate by the fixing roller (i.e., fixing member) 50. A pressing roller (i.e., pressing member) 70 is pressed against the fixing roller 50 with the fixing belt 40 therebetween. The pressing roller 70 internally contains a heater 75, and is covered with a rubber and a surface layer comprising a fluorine-containing resin. Switching of the heater 65 is controlled based on the temperature of the fixing belt 40 contacting the heating roller 60, detected by a detector 62. Similarly, switching of the heater 75 is controlled based on the temperature of the pressing roller 70, detected by a detector 72.

A paper sheet having a toner image thereon passes through a portion where the pressing roller 70 presses against the fixing roller 50 while receiving heat and pressure from the fixing belt 40 heated by the heating roller 60. Thus, the toner image is fixed on the sheet. The sheet is then separated from the fixing belt 40 and the pressing roller 70 by separation members 81 and 82, and fed to the discharger 6. A ligulate part 76 is an edge of an arm (ARM) bended in a direction vertical to the paper plane illustrating FIG. 2. The arm (ARM) draws the pressing roller 70 away from the fixing roller 50, or brings the pressing roller 70 into contact with the fixing roller 50. A spring 77 biases the arm (ARM) so that the arm (ARM) draws away from fixing roller 50. A cam 78 is driven to rotate by a motor so that the arm (ARM) draws the pressing roller 70 away from the fixing roller 50, or brings the pressing roller 70 into contact with the fixing roller 50. A roller 90 supports the fixing belt 40. A spring 91 controls the tensile force of the fixing belt 40.

Figure 4:
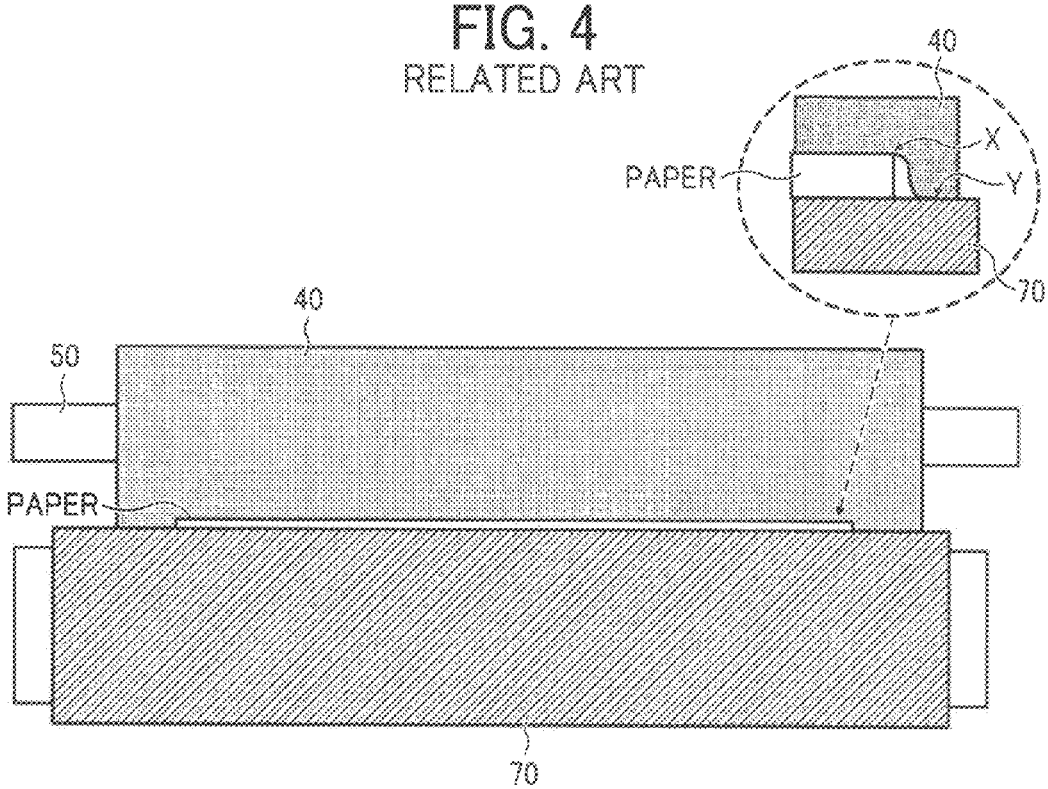
FIG. 4 RELATED ART
FIG. 4 schematically illustrates an embodiment of a related-art fixing device.

FIG. 4 schematically illustrates an embodiment of a related-art fixing device. In FIG. 4, the fixing belt 40 comprises a fluorine-containing resin on its surface and the fixing roller 50 comprises a soft elastic body. When a sheet of paper passes through the portion where the pressing roller 70 presses against the fixing roller 50, a linear velocity difference is made between a portion X of the fixing belt 40 where contacting an edge of the sheet and a portion Y of the fixing belt 40 where contacting the pressing roller 70, as illustrated in FIG. 4. The linear velocity difference makes the fixing belt 40 strongly scratched with the edge of the sheet.

The linear velocity difference is increased as the cut surface of the sheet edge gets rougher or paper powder gets more accumulated. Continuous passing of small-size sheets makes scratches on the fixing belt 40, and the scratches undesirably appear as low-gloss lines in a solid image on a large-size sheet thereafter. Passing of maximum-size sheets does not cause such a problem because no image is produced on an area beyond the edge of the maximum-size sheets. In a market in which the maximum-size sheet in use is A4 or LT and small-size sheets are not frequently used, the above-described problem may not frequently occur. By contrast, in a market in which the maximum-size sheet in use is greater than A4 or LT and A4 or LT sheets are frequently used, the above-described problem frequently occurs.

In the present embodiment, as illustrated in FIG. 3, the pressing roller 70 has a height difference 70*a* that is tapered from an end portion toward a portion contacting an edge of the small-size sheet while forming a taper angle of 20 to 45 degrees and a height difference of 100 to 200 μm. Owing to the height difference 70*a*, the linear velocity difference between the portions X and Y is reduced when the small-size sheet is passed. Thus, the pressure from the edge of the small-size sheet to the fixing belt 40 is also reduced, preventing the edge of the small-size sheet from scratching the fixing belt 40. Large-size sheets can deform along the tapered shape because of their small stiffness, and make no influence on fixability. Thus, the present embodiment can reliably produce images on both large-size and small-size sheets without causing low-gloss lines.

Figure 6:
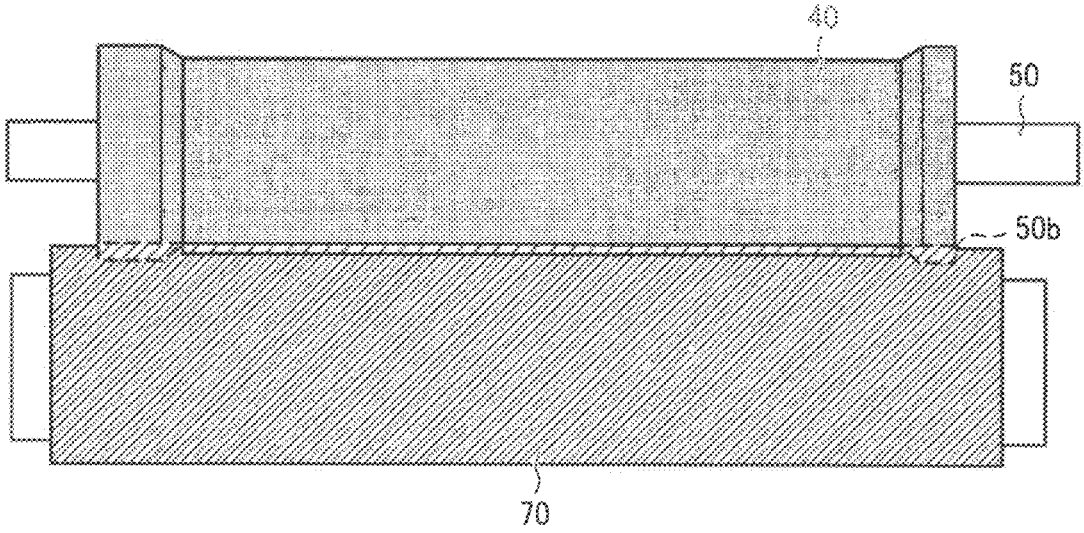
FIG. 6 RELATED ART
FIG. 6 schematically illustrates an embodiment of a related-art fixing device.

Because the fixing roller 50 has a lower hardness than the pressing roller 70, the fixing roller 50 deforms at their contact portion, as illustrated in FIG. 2. Therefore, when a height difference 50*b* is provided to the fixing roller 50, which is softer, as illustrated in FIG. 6, the height difference 50*b* disappears due to the pressure from the pressing roller 70. Thus, the pressure from the edge of the small-size sheet to the fixing belt 40 cannot be reduced and the edge of the small-size sheet scratches the fixing belt 40. By contrast, when a height difference 70*a* is provided to the pressing roller 70, which is harder, as illustrated in FIG. 3, the height difference 70*a* never disappears or deforms. Thus, the pressure from the edge of the small-size sheet to the fixing belt 40 can be reduced, preventing the edge of the small-size sheet from scratching the fixing belt 40. The embodiment 1 can reliably produce images without causing low-gloss lines.

Embodiment 2

Figure 5:
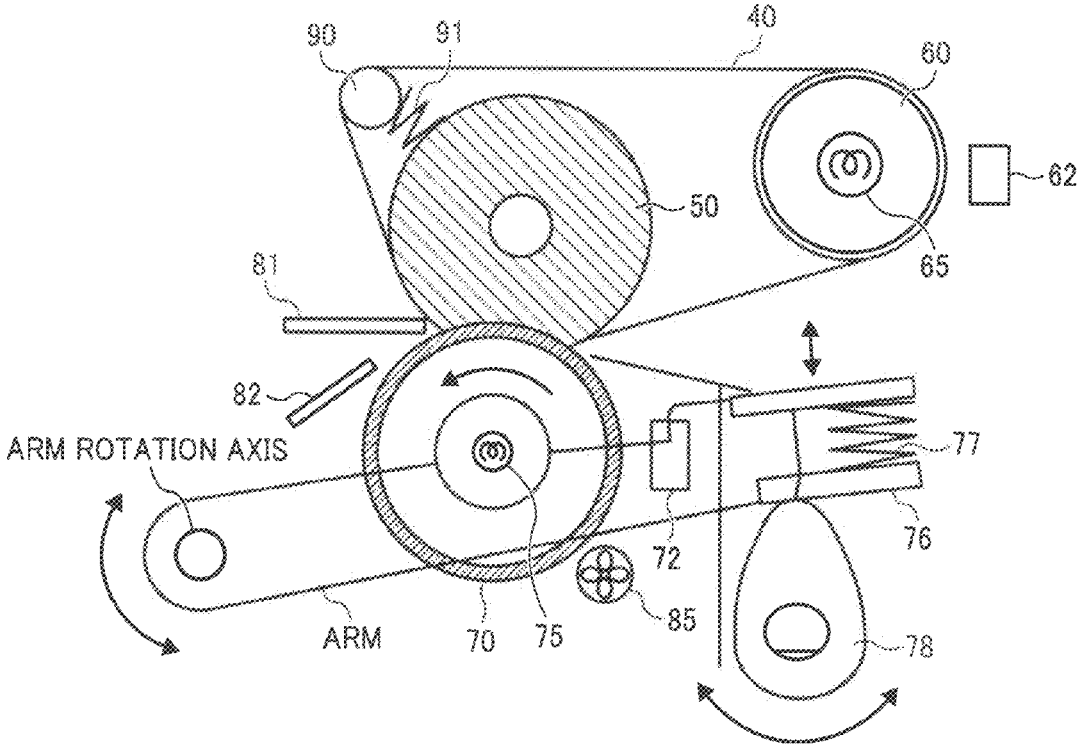
FIG. 5 schematically illustrates another embodiment of the fixing device employed in the image forming apparatus illustrated in FIG. 1.

The embodiment 1 relates to one-side printing in which low-gloss lines may appear on a toner image to be fixed on a sheet by passing through the pressing point of the pressing roller 70 against the fixing roller 50 while receiving heat from the fixing belt 40 heated by the heating roller 60. The present embodiment 2 relates to duplex printing in which low-gloss lines may also appear on the already fixed toner image on the other side of the sheet. In the present embodiment, a fan 85 for cooling the pressing roller 70 is further provided, as illustrated in FIG. 5, so that heat from the pressing roller 70 does not adversely affect gloss of the already fixed toner image. Thus, low-gloss lines do not appear on toner images on both sides of the sheet. The embodiment 2 can reliably produce images without causing low-gloss lines even in duplex-printing.

Embodiment 3

Figure 7:
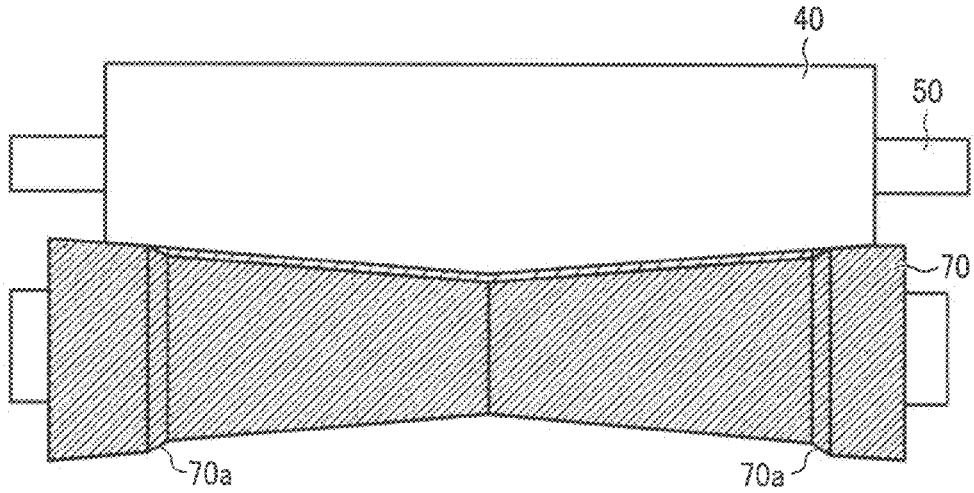
FIGS. 7 to 19 each schematically illustrate embodiments of the rollers illustrated in FIG. 3.

FIG. 7 schematically illustrates another embodiment of the rollers illustrated in FIG. 3. In embodiment 1 illustrated in FIG. 3, the circumferential surface of the center portion of the pressing roller 70, lying between the height differences 70*a*, is parallel to the axis. In that embodiment, sheets are likely to wrinkle due to lack of stretching effect in sheet feeding. In the present embodiment 3 illustrated in FIG. 7, the pressing roller 70 is tapered from both end portions toward the center portion in the axial direction. Additionally, a height difference 70*a* is provided so that the circumferential surfaces of the end portions and the center portion are parallel. The embodiment 3 can reliably produce images without making wrinkles on sheets due to stretching effect in sheet feeding.

Embodiment 4

Figure 8:
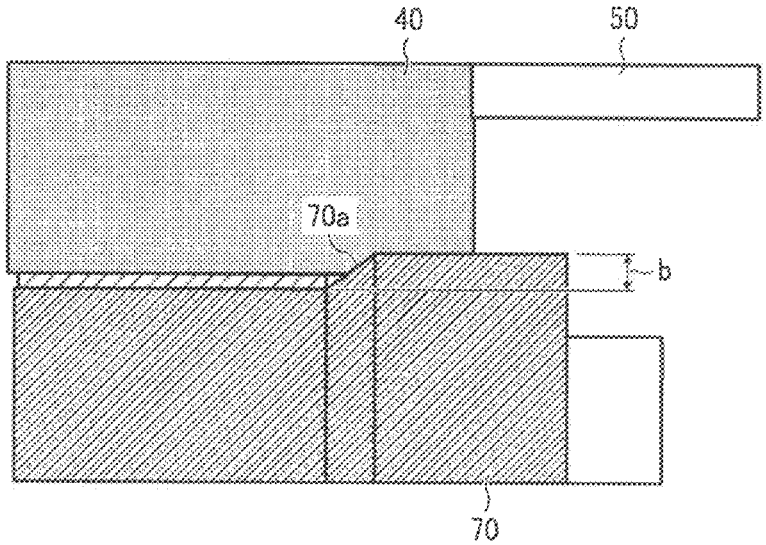

FIG. 8 schematically illustrates another embodiment of the rollers illustrated in FIG. 3. In the present embodiment 4 illustrated in FIG. 8, a difference b in height between the end portion and the center portion of the pressing roller 70 is greater than the thickness of the sheet. Thus, the pressure from the sheet edge is received by the height difference 70*a*, preventing the sheet edge from scratching the fixing belt 40. The embodiment 4 can reliably produce images without causing low-gloss lines.

Embodiment 5

Figure 9:
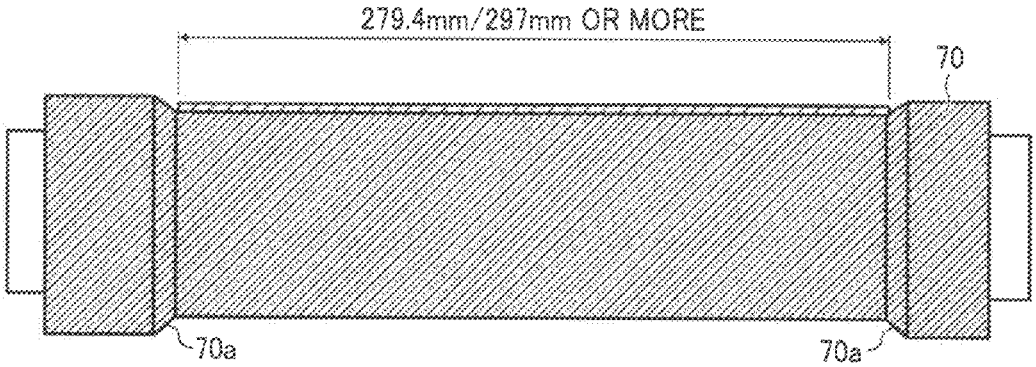

FIG. 9 schematically illustrates another embodiment of the rollers illustrated in FIG. 3. In the present embodiment 5 illustrated in FIG. 9, the center portion lying between the height differences 70*a* has a length of 279.4 mm or more, or 297 mm or more. In the United States, LT (279.4 mm×215.9 mm) and DLT (431.8 mm×279.4 mm) sheets are generally used, and both LT and DLT sheets pass through the fixing roller 50 with leading a 279.4-mm edge. In the other countries, A4 (297 mm×210 mm) and A3 (420 mm×297 mm) sheets are generally used, and both A4 and A3 sheets pass through the fixing roller 50 with leading a 297-mm edge. Passing of sheets smaller than DLT or A3 may make scratches on the fixing belt 40, but such scratches can be eliminated by abrasion owing to passing of LT/DLT or A4/A3 with leading a 279.4-mm or 297-mm edge, respectively. On the other hand, passing of sheets having a leading edge greater than 279.4 mm or 297 mm may make scratches on the fixing belt 40 and cause low-gloss lines in the resulting image. Thus, in the present embodiment, the height differences 70*a* are provided to the pressing member 70 so that the distance therebetween has a length of 279.4 mm or more, or 297 mm or more. The embodiment 5 can reliably produce images without causing low-gloss lines.

Embodiment 6

Figure 10:
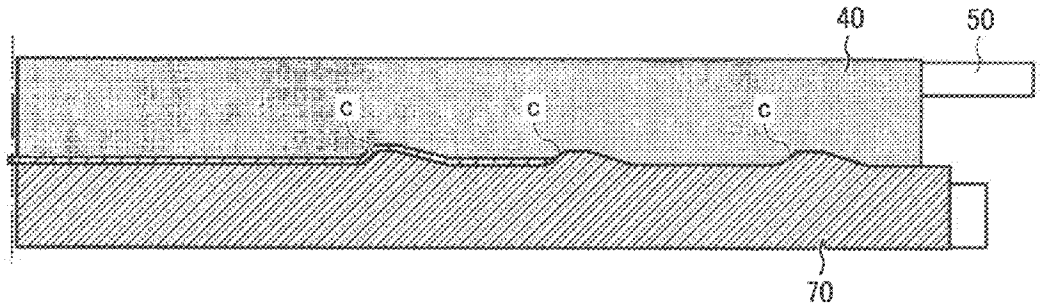

FIG. 10 schematically illustrates another embodiment of the rollers illustrated in FIG. 3. The present embodiment 6 is for a case in which multiple small-size sheets are frequently used. Multiple protrusions c are provided to the positions where the edges of the multiple frequently-used small-size sheets pass. Each of the protrusions c is gradually tapered toward both the center and end portions of the pressing roller 70.

Embodiment 7

Figure 11:
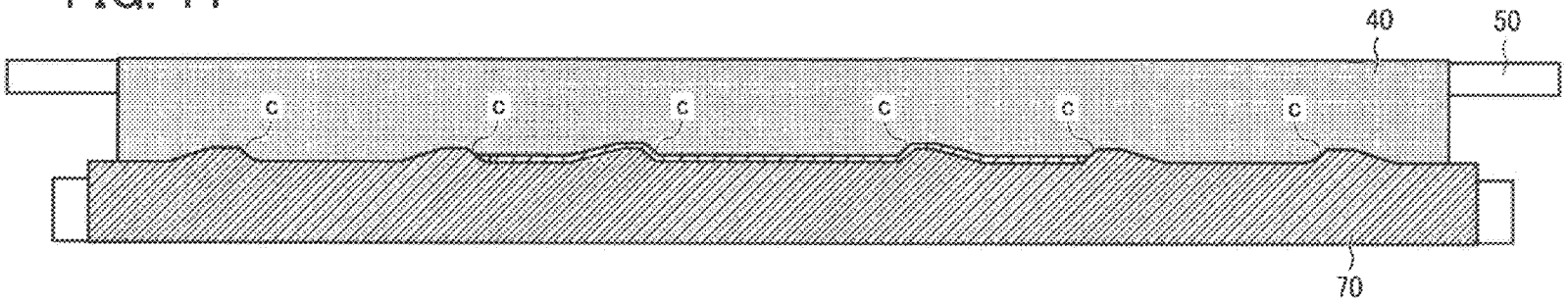

FIG. 11 schematically illustrates another embodiment of the rollers illustrated in FIG. 3. In the above-described embodiments, a sheet generally receives stretching force from each height difference 70*a*. In embodiment 6 illustrated in FIG. 10, a sheet receives a greater stretching force because multiple protrusions c are provided. If stretching forces received by the right and left ends on the pressing roller 70 are not balanced, the sheet is likely to wrinkle. To prevent wrinkling of the sheet, protrusions c are symmetrically provided to the pressing roller 70 in the present embodiment. The embodiment 7 can reliably produce images without causing low-gloss lines even when multiple small-size sheets are frequently used.

Embodiment 8

Figure 12:
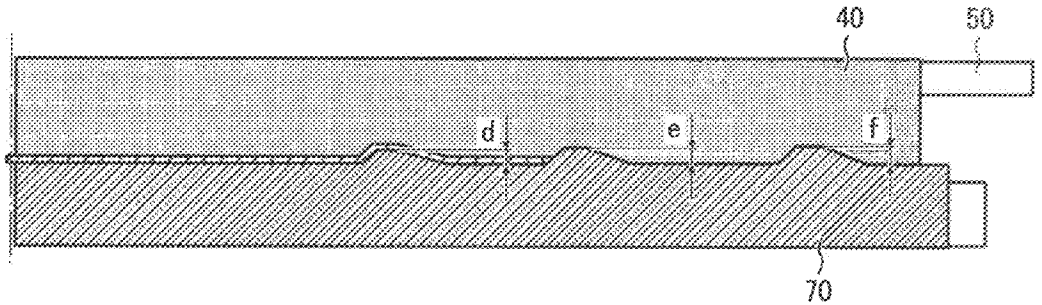

FIG. 12 schematically illustrates another embodiment of the roller with protrusions d, e, and f illustrated in FIG. 3. In the present embodiment, a protrusion provided closer to the end portion is higher than that provided closer to the center portion as shown in FIG. 11 (d<e<f). Thus, the pressing roller 70 is substantially tapered from the end portion toward the center portion in the axial direction, thereby preventing wrinkling of the sheet. The embodiment 8 can reliably produce images without causing low-gloss lines even when multiple small-size sheets are frequently used.

The below-described embodiments more reliably prevent the occurrence of uneven gloss or wrinkles on large-size sheets while preventing the edges of small-size sheets from scratching the fixing belt 40.

Embodiment 9

Figure 13:
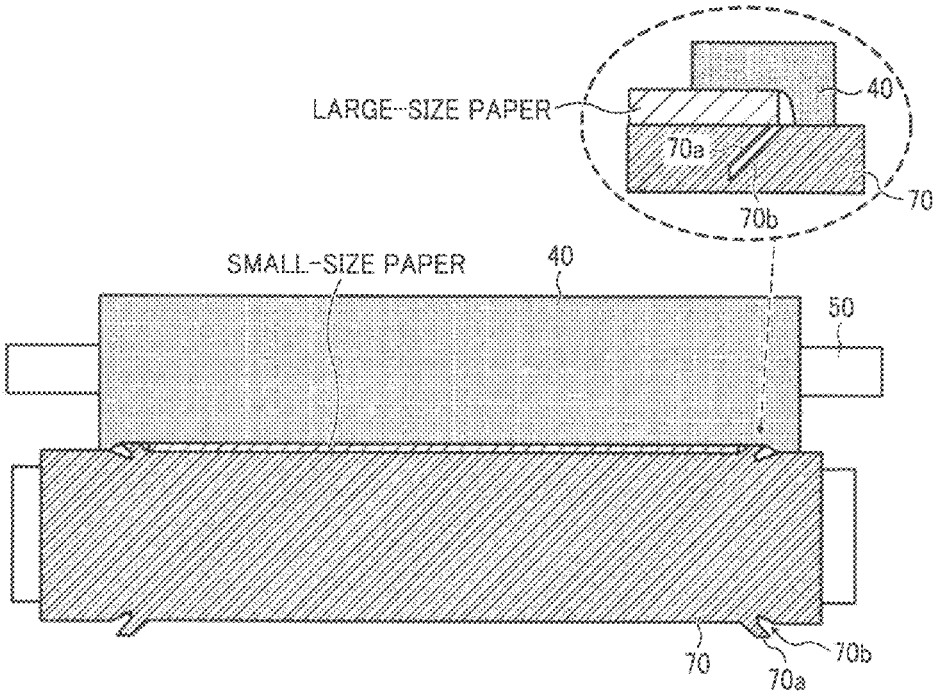

FIG. 13 schematically illustrates another embodiment of the rollers illustrated in FIG. 3. In the present embodiment, the pressing roller 70 has a height difference 70*a* tapered from an end portion toward a portion contacting an edge of the small-size sheet while forming a taper angle of 20 to 45 degrees and a height difference of 100 to 200 μm.

Owing to the height difference 70*a*, the linear velocity difference between the portions X and Y is reduced when the small-size sheet is in use. Thus, the pressure from the edge of the small-size sheet to the fixing belt 40 is also reduced, preventing the edge of the small-size sheet from scratching the fixing belt 70. When passing large-size sheets, the height difference 70*a* is buried in a groove portion 70*b* owing to the nip pressure. Thus, the large-size sheets receive a uniform pressure, preventing the occurrence of uneven gloss and wrinkles.

The present embodiment can reliably produce images on both large-size and small-size sheets without causing low-gloss lines, while particularly preventing the occurrence of uneven gloss and wrinkles on large-size sheets.

In the present embodiment illustrated in FIG. 13, the height difference 70*a* does not deform when passing small-size sheets due to the existence of a space formed between the edge of the sheet and the height difference 70*a*. Owing to the height difference 70*a*, the linear velocity difference between the portions X and Y is reduced when the small-size sheet is passed. Thus, the pressure from the edge of the small-size sheet to the fixing belt 40 is also reduced, preventing the edge of the small-size sheet from scratching the fixing belt 40. By contrast, when passing large-size sheets, the height difference 70*a* is buried in the groove portion 70*b* owing to the nip pressure between the fixing roller 50 and the pressing roller 70. Thus, the large-size sheets receive a uniform pressure, preventing the occurrence of uneven gloss and wrinkles. The present embodiment can reliably produce images on both large-size and small-size sheets without causing low-gloss lines, while particularly preventing the occurrence of uneven gloss and wrinkles on large-size sheets.

Embodiment 10

Figure 14:
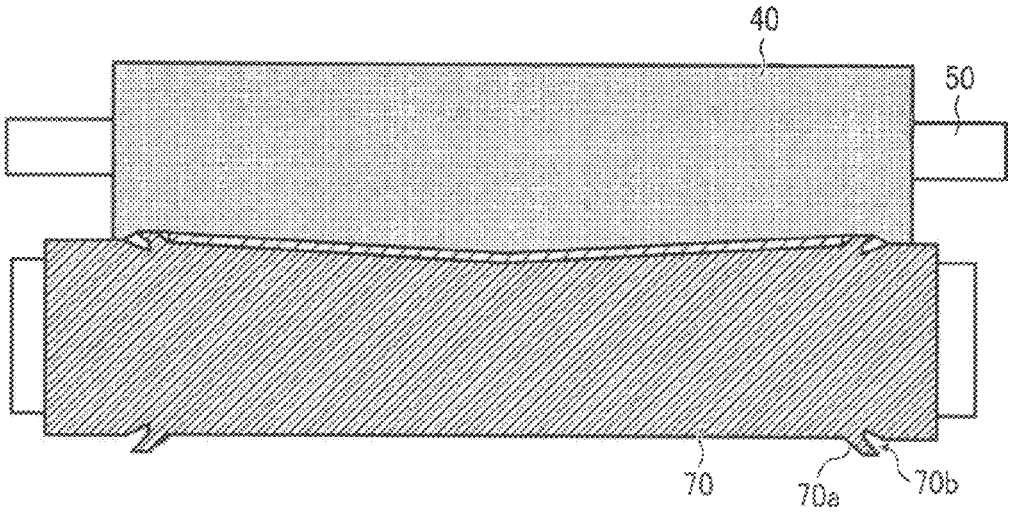

In embodiment 9 illustrated in FIG. 13, the circumferential surface of the center portion of the pressing roller 70, lying between the height differences 70*a*, is parallel to the axis. In that embodiment, sheets are likely to wrinkle due to lack of stretching effect in sheet feeding. In the present embodiment 10 illustrated in FIG. 14, the pressing roller 70 is tapered from both end portions toward the center portion in the axial direction. Additionally, a height difference 70*a* is provided. The embodiment 10 can reliably produce images without making wrinkles even on large-size sheets due to stretching effect in sheet feeding.

Embodiment 11

Figure 15:
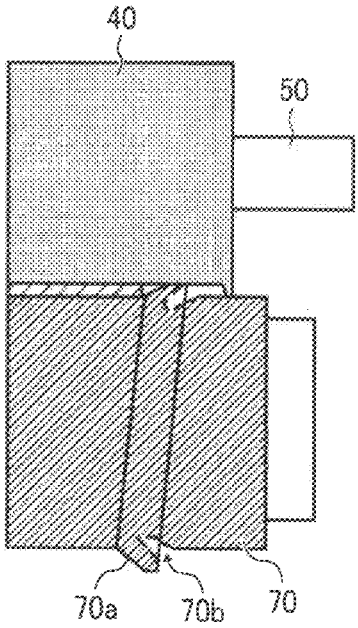

In the present embodiment 11 illustrated in FIG. 15, a height difference 70*a* is higher than the thickness of the sheet. Thus, the pressure from the sheet edge is received by the height difference 70*a*, preventing the sheet edge from scratching the fixing belt 40. Additionally, the height difference 70*a* is buried in the groove portion 70*b* owing to the nip pressure between the fixing roller 50 and the pressing roller 70. Because the height difference 70*a* is spirally provided to the circumferential surface of the pressing roller 70, no pressure difference is generated on the same position in the axial direction. The embodiment 11 can reliably produce images without causing low-gloss lines on large-size sheets.

Embodiment 12

Figure 16:
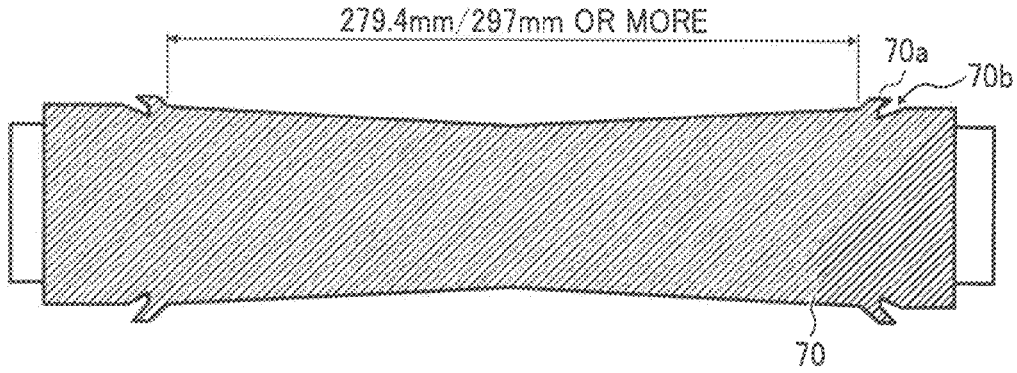

In the present embodiment 12 illustrated in FIG. 16, the center portion lying between the height differences 70*a* has a length of 279.4 mm or more, or 297 mm or more. In the United States, LT (279.4 mm×215.9 mm) and DLT (431.8 mm×279.4 mm) sheets are generally used, and both LT and DLT sheets pass through the fixing roller 50 with leading a 279.4-mm edge. In the other countries, A4 (297 mm×210 mm) and A3 (420 mm×297 mm) sheets are generally used, and both A4 and A3 sheets pass through the fixing roller 50 with leading a 297-mm edge. Passing of sheets smaller than DLT or A3 may make scratches on the fixing belt 40, but such scratches can be eliminated by abrasion owing to passing of LT/DLT or A4/A3 with leading a 279.4-mm or 297-mm edge, respectively. On the other hand, passing of sheets having a leading edge greater than 279.4 mm or 297 mm may make scratches on the fixing belt 40 and cause low-gloss lines in the resulting image. Thus, in the present embodiment, height differences 70*a* and groove portions 70*b* are provided to the pressing member 70 so that the distance between the height differences 70*a* has a length of 279.4 mm or more, or 297 mm or more. The embodiment 12 can reliably produce images without causing low-gloss lines.

Embodiment 13

Figure 17:
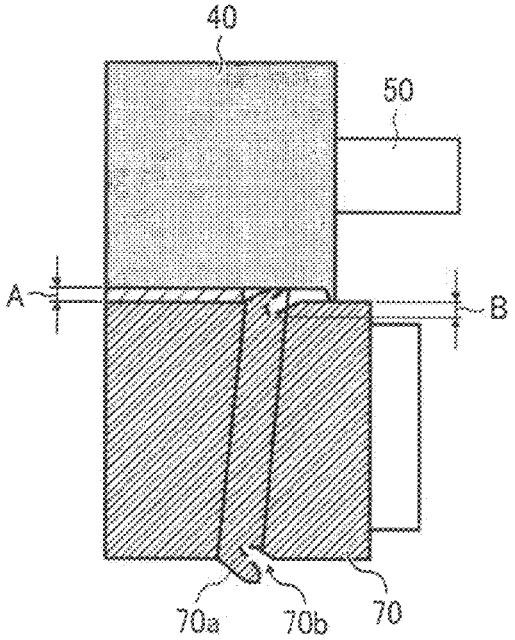

In the present embodiment 13 illustrated in FIG. 17, when passing large-size sheets, the height difference 70*a* is reliably buried in the groove portion 70*b* owing to the nip pressure between the fixing roller 50 and the pressing roller 70, thus forming a flat circumferential surface. This is because a depth B of the groove portion 70*b* is greater than a height A of the height difference 70*a*. The embodiment 13 can reliably produce images without making wrinkles even on large-size sheets due to the flat circumferential surface of the pressing roller 70.

Embodiment 14

Figure 18:
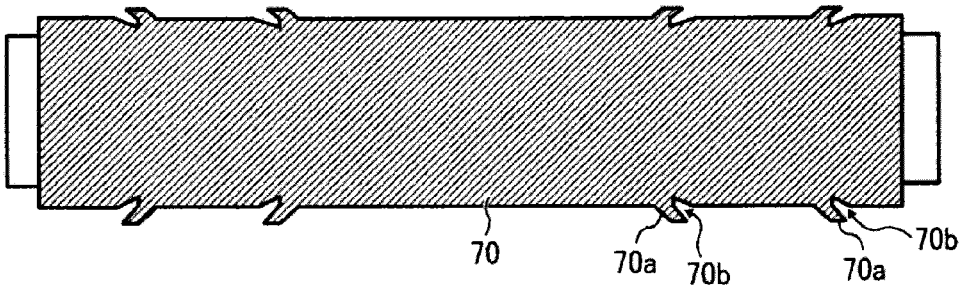

In the above-described embodiment 9 illustrated in FIG. 13, a sheet generally receives stretching force from each height difference 70*a*. In the present embodiment 14 illustrated in FIG. 18, a sheet receives a greater stretching force because multiple height differences 70*a* are provided. If stretching forces received by the right and left ends on the pressing roller 70 are not balanced, the sheet is likely to wrinkle. To prevent wrinkling of the sheet, the height differences 70*a* and the groove portions 70*b* are symmetrically provided to the pressing roller 70 in the present embodiment. The embodiment 14 can reliably produce images without causing wrinkling of the sheets.

Embodiment 15

Figure 19:
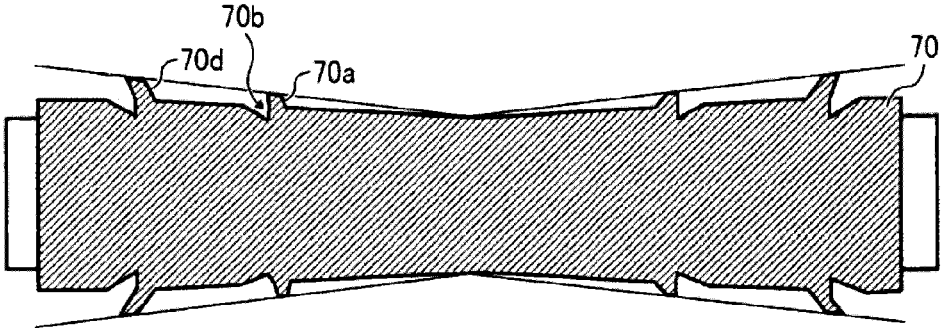

In the present embodiment 15 illustrated in FIG. 19, a height difference 70*d* provided closer to the end portion is higher than a height difference 70*a* provided closer to the center portion as shown in FIG. 19. Thus, the pressing roller 70 is substantially tapered from the end portion toward the center portion in the axial direction, thereby preventing wrinkling of the sheet. The embodiment 15 can reliably produce images without causing wrinkling of the sheets.

Additional modifications and variations of the present invention are possible in light of the above teachings. It is therefore to be understood that within the scope of the appended claims the invention may be practiced other than as specifically described herein.

What is claimed is:

1. A fixing device, comprising:

a fixing member to fix a toner image on a sheet by application of heat and pressure; and a pressing member to press the sheet against the fixing member, the pressing member being rotatable, wherein a height difference is circumferentially provided to the pressing member, the height difference tapered from an end portion toward a portion contacting an edge of a small-size sheet, and wherein the pressing member has a greater hardness than the fixing member.

2. The fixing device according to claim 1, wherein the pressing member contacts an opposite side of the sheet on which the toner image is to be fixed, the pressing member being cooled.

3. The fixing device according to claim 1, wherein an outer diameter of the pressing member at the end portion is greater than that at a center portion.

4. The fixing device according to claim 1, wherein a height of the height difference is greater than a thickness of the sheet.

5. The fixing device according to claim 1, wherein a distance between the height differences in an axial direction is 279.4 mm or more, or 297 mm or more.

6. The fixing device according to claim 1, wherein the pressing member has multiple protrusions each comprising said height difference and another height difference gradually tapered toward the end portion.

7. The fixing device according to claim 6, wherein the multiple protrusions are symmetrically provided with respect to a center portion of the pressing member.

8. The fixing device according to claim 6, wherein a protrusion being closer to the end portion is higher than another protrusion being closer to the center portion.

9. An image forming apparatus, comprising the fixing device according to claim 1.

10. The fixing device according to claim 1, wherein a groove portion is further circumferentially provided on an end-portion-side of the height difference.

11. The fixing device according to claim 10, wherein the height difference is buried in the groove portion to form a smooth circumferential surface of the pressing member when the sheet is covering the groove portion.

12. The fixing device according to claim 11, wherein an outer diameter of the pressing member at the end portion is greater than that at a center portion.

13. The fixing device according to claim 10, wherein the pressing member contacts an opposite side of the sheet on which the toner image is to be fixed, the pressing member being cooled.

14. The fixing device according to claim 10, wherein the height difference is spirally provided to the pressing member in a circumferential direction.

15. The fixing device according to claim 10, wherein a distance between the height differences in an axial direction is 279.4 mm or more, or 297 mm or more.

16. The fixing device according to claim 10, wherein a height of the height difference is smaller than a depth of the groove portion.

17. The fixing device according to claim 10, wherein the pressing member has multiple protrusions each comprising said height difference and another height difference gradually tapered toward the end portion, and wherein the multiple protrusions are symmetrically provided with respect to a center portion of the pressing member.

18. The fixing device according to claim 17, wherein a protrusion being closer to the end portion is higher than another protrusion being closer to the center portion.

19. An image forming apparatus, comprising the fixing device according to claim 10.

* * * * *